US008698022B2

(12) United States Patent
Kawakami

(10) Patent No.: US 8,698,022 B2
(45) Date of Patent: Apr. 15, 2014

(54) SEAL STRUCTURE FOR SWITCH MECHANISM AND ELECTRIC POWER TOOL

(75) Inventor: Takahiro Kawakami, Anjo (JP)

(73) Assignee: Makita Corporation, Anjo (JP)

( * ) Notice: Subject to any disclaimer, the term of this patent is extended or adjusted under 35 U.S.C. 154(b) by 188 days.

(21) Appl. No.: 13/213,801

(22) Filed: Aug. 19, 2011

(65) Prior Publication Data

US 2012/0061216 A1 Mar. 15, 2012

(30) Foreign Application Priority Data

Sep. 15, 2010 (JP) ..... 2010-207024

(51) Int. Cl.
*H01H 13/06* (2006.01)

(52) U.S. Cl.
USPC ..... 200/302.2

(58) Field of Classification Search
USPC ..... 200/302.2, 302.3, 318.1, 216, 231, 522; 451/69, 449, 450, 70, 158, 448; 173/170
See application file for complete search history.

(56) References Cited

U.S. PATENT DOCUMENTS

| | | | | |
|---|---|---|---|---|
| 3,194,084 | A * | 7/1965 | Filander | 74/527 |
| 3,790,734 | A | 2/1974 | Raab et al. | |
| 5,957,272 | A * | 9/1999 | Kim | 200/512 |
| 2009/0013536 | A1 * | 1/2009 | Kaiser et al. | 30/123.3 |

FOREIGN PATENT DOCUMENTS

| | | |
|---|---|---|
| DE | 1 753 696 U | 10/1957 |
| GB | 302433 | 12/1928 |
| JP | U-61-726 | 1/1986 |
| JP | U-3-92331 | 9/1991 |
| JP | A-09-193136 | 7/1997 |
| JP | A-2002-140758 | 5/2002 |
| JP | A-2010-167542 | 8/2010 |

OTHER PUBLICATIONS

Jan. 4, 2013 Extended European Search Report issued in European Patent Application No. 11179309.7.

Feb. 18, 2014 Office Action issued in Japanese Patent Application No. 2010-207024 (with English Translation).

* cited by examiner

*Primary Examiner* — Renne Luebke
*Assistant Examiner* — Harshad Patel
(74) *Attorney, Agent, or Firm* — Oliff PLC

(57) ABSTRACT

A seal structure for a switch mechanism includes a switch disposed in a housing, an operating member protruding forward from the housing through an opening formed in the housing and configured to turn on or off the switch, a rubber cover attached to the operating member from a front-side of the operating member and having a rear end engageable with the opening, and a fixing cover fixed to the operating member from outside the rubber cover so as to integrate the rubber cover with the operating member. In this seal structure, the rubber cover seals gap between the opening and the operating member.

11 Claims, 6 Drawing Sheets

SEAL STRUCTURE FOR SWITCH MECHANISM AND ELECTRIC POWER TOOL

BACKGROUND OF THE INVENTION

This application claims the entire benefit of Japanese Patent Application Number 2010-207024 filed on Sep. 15, 2010, the entirety of which is incorporated by reference.

TECHNICAL FIELD

The present invention relates to a seal structure provided in an electric power tool which includes a housing, a switch disposed in the housing, and a switch mechanism having an operating member protruding forward from the housing through an opening formed in the housing for turning on or off the switch, the seal structure sealing gap between the opening and the operating member. The present invention also relates to an electric power tool which employs the seal structure.

BACKGROUND ART

In equipment such as an electric power tool, a switch for operating a driving source such as a motor is disposed in a housing, and an operating member for turning on or off the switch (e.g., a trigger or a switch lever) protrudes forward from the housing through an opening formed in the housing. In such a switch mechanism, a seal structure may often be used in order to prevent dust or water from entering a gap between the opening and the operating member. As a known structure of this seal mechanism, Japanese Laid-open Utility Model Application, Publication No. S61-726 discloses that the operating member is covered from outside by a bag-shaped rubber cover which is slightly larger than the operating member and that an opening of the rubber cover is locked by locking means such as a collar along the inner fringe of the opening of the housing.

However, in the above conventional seal structure, depressing the operating member causes the rubber cover to sag, and whenever the operating member is depressed, the rubber cover is bought into contact with the edge of the opening of the housing. This may cause a damage or degradation of the rubber cover, leading to a decrease in durability of the seal mechanism.

Meanwhile, in consideration of workability, the switch of the electric power tool may have a lock-on mechanism for maintaining the switch in an ON-state, in which the operating member has been depressed. However, if the lock-on mechanism is covered with the rubber cover, the rubber cover returns to its original position while the operating member is kept in the depressed position, so that it is difficult for the user to identify where the operating member is positioned. This leads to poor usability.

In view of the above drawback of the conventional seal structure, the present invention seeks to provide a seal structure for a switch mechanism, which can suitably seal gap between the opening of the housing and the operating member and further excels in durability of the seal and provides better usability, and an electric power tool employing this seal structure.

SUMMARY OF THE INVENTION

In order to achieve the above object, in accordance with a first aspect of the present invention, as embodied and described herein, there is provided a seal structure for a switch mechanism comprising a switch disposed in a housing, an operating member protruding forward from the housing through an opening formed in the housing and configured to turn on or off the switch, a rubber cover attached to the operating member from a front-side of the operating member and having a rear end engageable with the opening, and a fixing cover fixed to the operating member from outside the rubber cover so as to integrate the rubber cover with the operating member, wherein the rubber cover seals gap between the opening and the operating member.

As a first specific embodiment of the aforementioned seal structure, the fixing cover may have a U-shaped transverse section for covering a front surface and right and left side surfaces of the rubber cover.

As a second specific embodiment of the seal structure according to the above first aspect or the first specific embodiment, the fixing cover may have an engagement nail which penetrates through the rubber cover and engageable with an engagement portion provided on the operating member.

As a third specific embodiment of the seal structure according to the above first aspect, the switch may have a lock-on mechanism configured to maintain the operating member in an ON-state, in which the operating member has been depressed and moved in a backward position.

According to other embodiments, the seal structure may be configured such that a bellows-like flange portion is formed at a rear end of the rubber cover and the flange portion is engaged with an engagement groove formed on an inner perimeter surface of the opening, that an inverted U-shaped protrusion is formed on each right and left side surface of the operating member and a fitting protrusion corresponding to the protrusion of the operating member is formed on each right and left side surface of the rubber cover so that when the rubber cover is attached to the operating member, the protrusions are fitted into the fitting protrusions, and that a cut-out corresponding to the fitting protrusion of the rubber cover is formed in each right and left side plate portion of the fixing cover so that the fitting protrusions can be fitted into the cut-outs.

In order to achieve the above object, in accordance with a second aspect of the present invention, as embodied and described herein, there is provided an electric power tool comprising a switch mechanism including a switch provided in a housing, and an operating member protruding forward from the housing through an opening formed in the housing and configured to turn on or off the switch, wherein the seal structure according to the first aspect is adopted for the switch mechanism.

As a first specific embodiment of the aforementioned electric power tool, a fluid supply mechanism may be provided so as to supply fluid to a tool bit attached to the housing.

With the configurations of the seal structure and the electric power tool according to the above first and second aspects of the present invention, the gap between the opening of the housing and the operating member can be suitably sealed by the rubber cover. Further, since the rubber cover is integrated with the operating member by the fixing cover, the rubber cover is less likely to contact the edge of the opening of the housing upon depressing the operating member, which can suppress a damage of the rubber cover and hence excel in the durability of the seal.

With the configuration of the seal structure according to the first specific embodiment, in addition to the above advantageous effects of the seal structure according to the first aspect of the present invention, it is possible to more effectively prevent the side surfaces of the rubber cover from contacting the edge of the opening.

With the configuration of the seal structure according to the second specific embodiment, in addition to the above advantageous effects of the seal structure according to the first aspect or the first specific embodiment of the present invention, the fixing cover can be easily fixed to the trigger because of the engagement nail and the engagement portion.

With the configuration of the seal structure according to the third specific embodiment, in addition to the above advantageous effects of the seal structure according to the first aspect of the present invention, the use state of the lock-on mechanism is reliably recognized and better usability can be achieved.

With the configuration of the electric power tool according to the first specific embodiment, in addition to the above advantageous effects of the electric power tool according to the second aspect of the present invention, a suitable seal can be applied to the gap between the opening of the housing and the operating member in an electric power tool equipped with a fluid supply mechanism.

BRIEF DESCRIPTION OF THE DRAWINGS

To better understand the claimed invention, and to show how the same may be carried into effect, reference will now be made, by way of example only, to the accompanying drawings.

DETAILED DESCRIPTION OF THE EXEMPLARY EMBODIMENT

One preferred embodiment of the present invention will be described with reference to the accompanying drawings.

Figure 1:
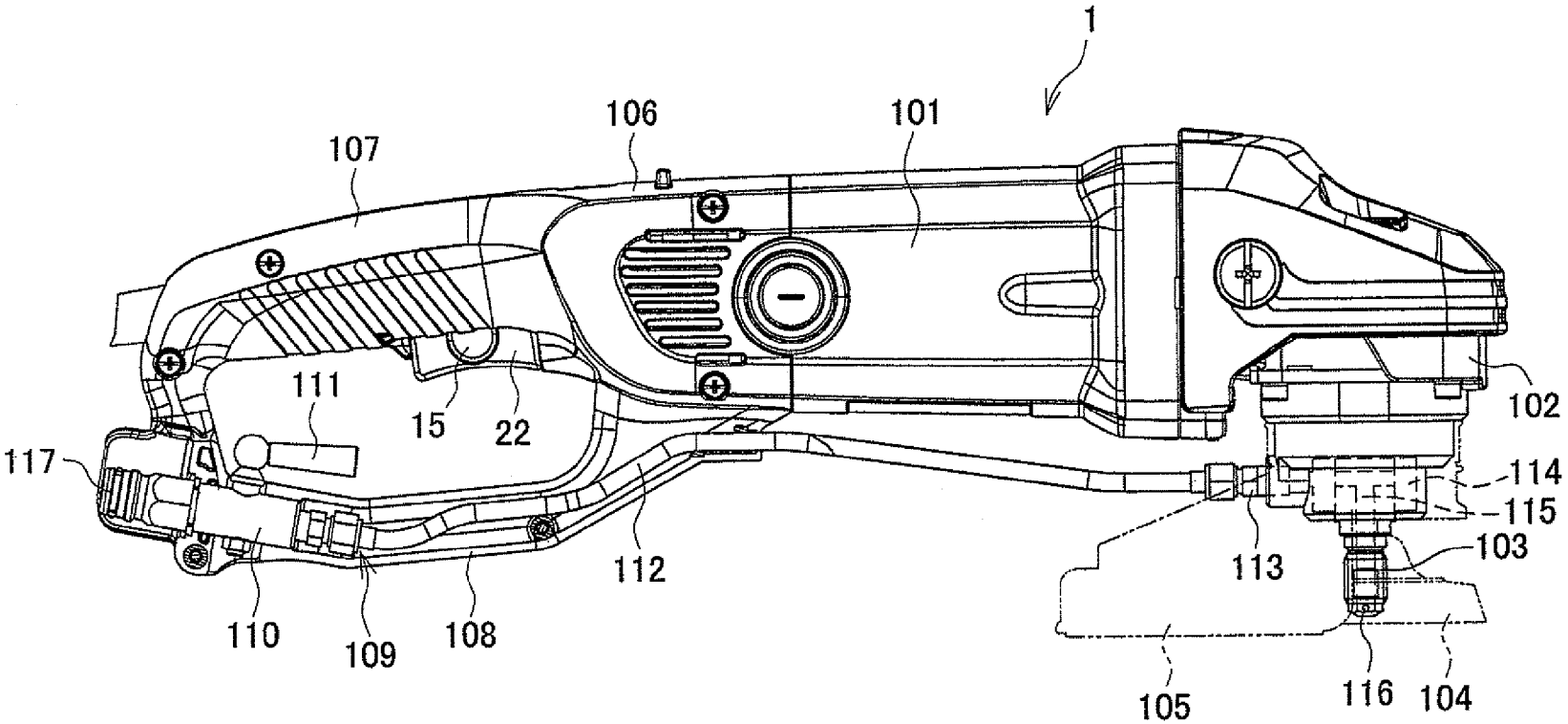
FIG. 1 is an overall view of a disc sander.

FIG. 1 shows a disc sander as an example of an electric power tool. The disc sander 1 includes a motor (not shown), a tubular motor housing 101 in which the motor is laterally disposed with an output shaft of the motor sticking out from the motor housing 101, a gear housing 102 connected at a front side (i.e., right-hand side of FIG. 1) of the motor housing 101, a rotary shaft 103 vertically and rotatably supported in the gear housing 102 with its upper end being connected to the output shaft through bevel gears and with its lower end sticking out from the bottom side of the gear housing 102, and a tool bit 104 such as a sanding disc attached to the lower end of the rotary shaft 103. Reference numeral 105 indicates a safety cover attached to a lower surface of the gear housing 102 and configured to cover a rear portion of the tool bit 104.

A handle housing 106 is connected to a rear side of the motor housing 101. The handle housing 106 has a rearwardly extending handle 107 equipped with a switch mechanism to be described later. In this handle housing 106, a guard portion 108 extends to form a loop at a lower portion of the handle 107 such that a lower space below the handle 107 is surrounded and protected by the guard portion 108. The handle housing 106 is formed by assembling a pair of right and left housing halves, in which the handle 107 and the guard portion 108 are integral and divided into right-side and left-side parts.

The disc sander 1 is equipped with a water filling mechanism 109 as a fluid supply mechanism. The water filling mechanism 109 includes a valve 110 provided with a lever 111 and disposed inside the guard portion 108 at the rear side of the guard portion 108, and a hose 112 extending along the lower side of the motor housing 101. One end of the hose 112 is inserted into the guard portion 108 from the front side of the guard portion 108 and connected to the front side of the valve 110. The other end of the hose 112 is connected to the rear surface of the gear housing 102 through a nozzle portion 113.

A ring-shaped water filling portion 114 is formed in the gear housing 102 around the rotary shaft 103, and a conduit 115 is formed along an axis of the rotary shaft 103 in communication with the water filling portion 114, so that water supplied from the nozzle portion 113 flows through the water filling portion 114 into the conduit 115 and is then ejected from an ejection port 116 provided at the lower end of the conduit 115. A plug 117 is provided at a rear portion of the valve 110. The plug 117 projects rearward from the rear end of the guard portion 108, so that a socket (not shown) for a water pipe or a hose connected to a supply source such as a pump can be connected to the plug 117.

Figure 2:
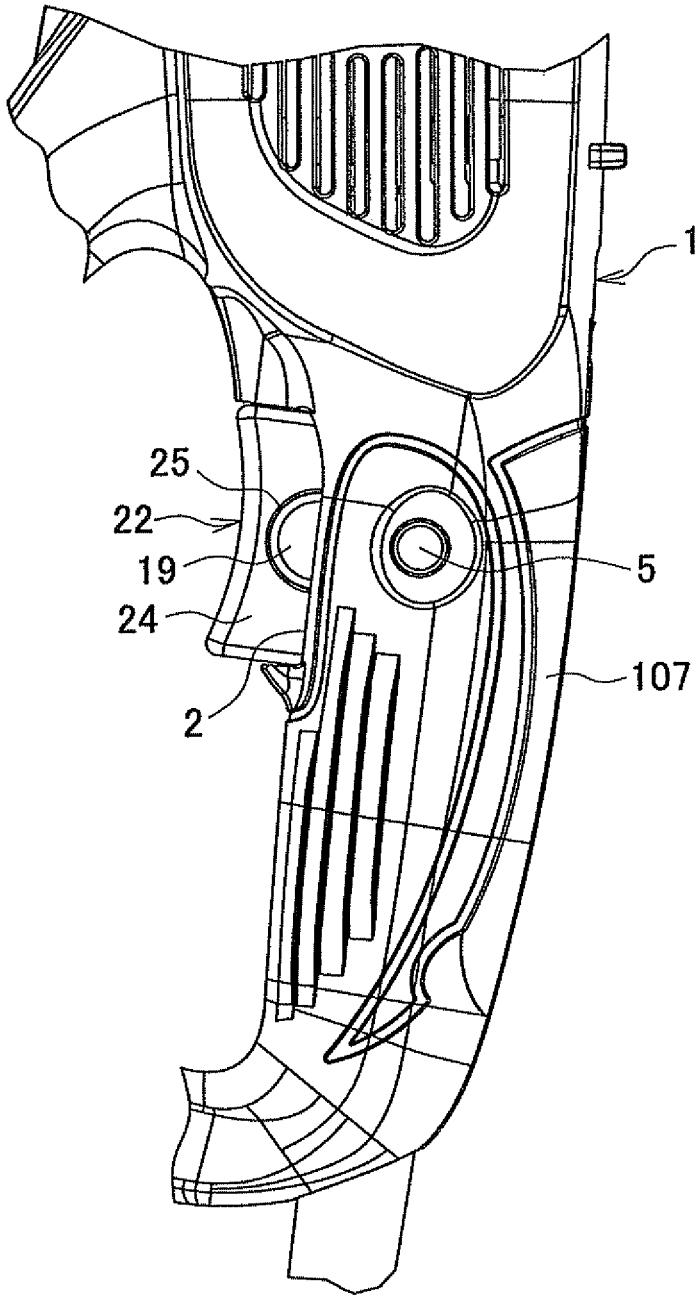
FIG. 2 is a side view of a handle of the disc sander.
Figure 3:
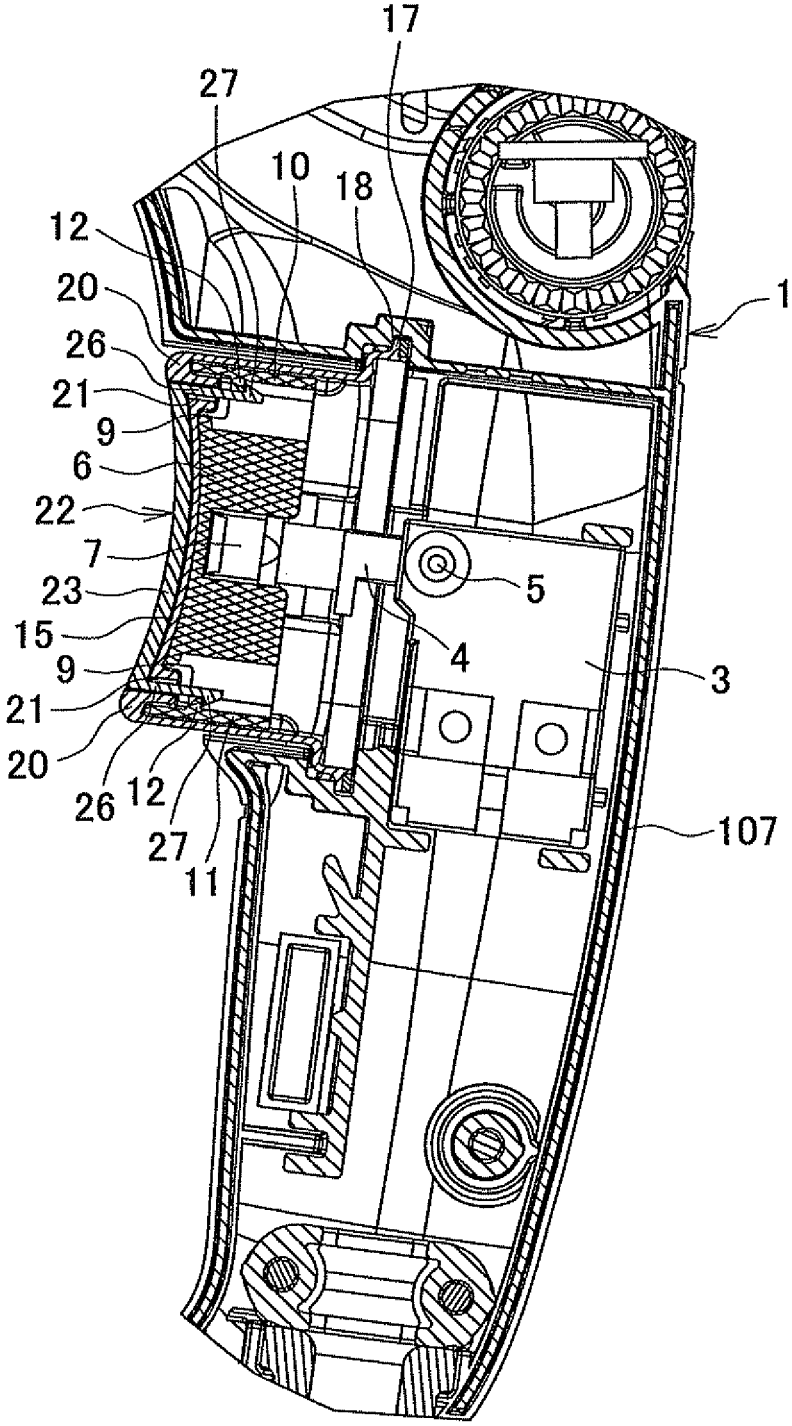
FIG. 3 is a longitudinal section of the handle of the disc sander.

Next, description will be given of the switch mechanism. FIG. 2 is a side elevation of the handle 107, and FIG. 3 is a longitudinal section of the handle 107. A switch 3 for actuating the motor (not shown) is disposed inside the handle 107 and supported with a plunger 4 protruding forward (left-hand side of FIGS. 2 and 3 corresponds to the front side of the switch mechanism). Further, a lock-on button 5 is provided on a side surface of the switch 3. The lock-on button 5 is configured to be depressed toward the switch 3 while the plunger 4 is being depressed (i.e., ON-state of the switch 3), so that the plunger 4 is retained in this position and the switch 3 is kept in the ON-state. The lock-on button 5 protrudes from the handle 107 in a side direction through a through-opening formed in the handle 107.

Figure 4:
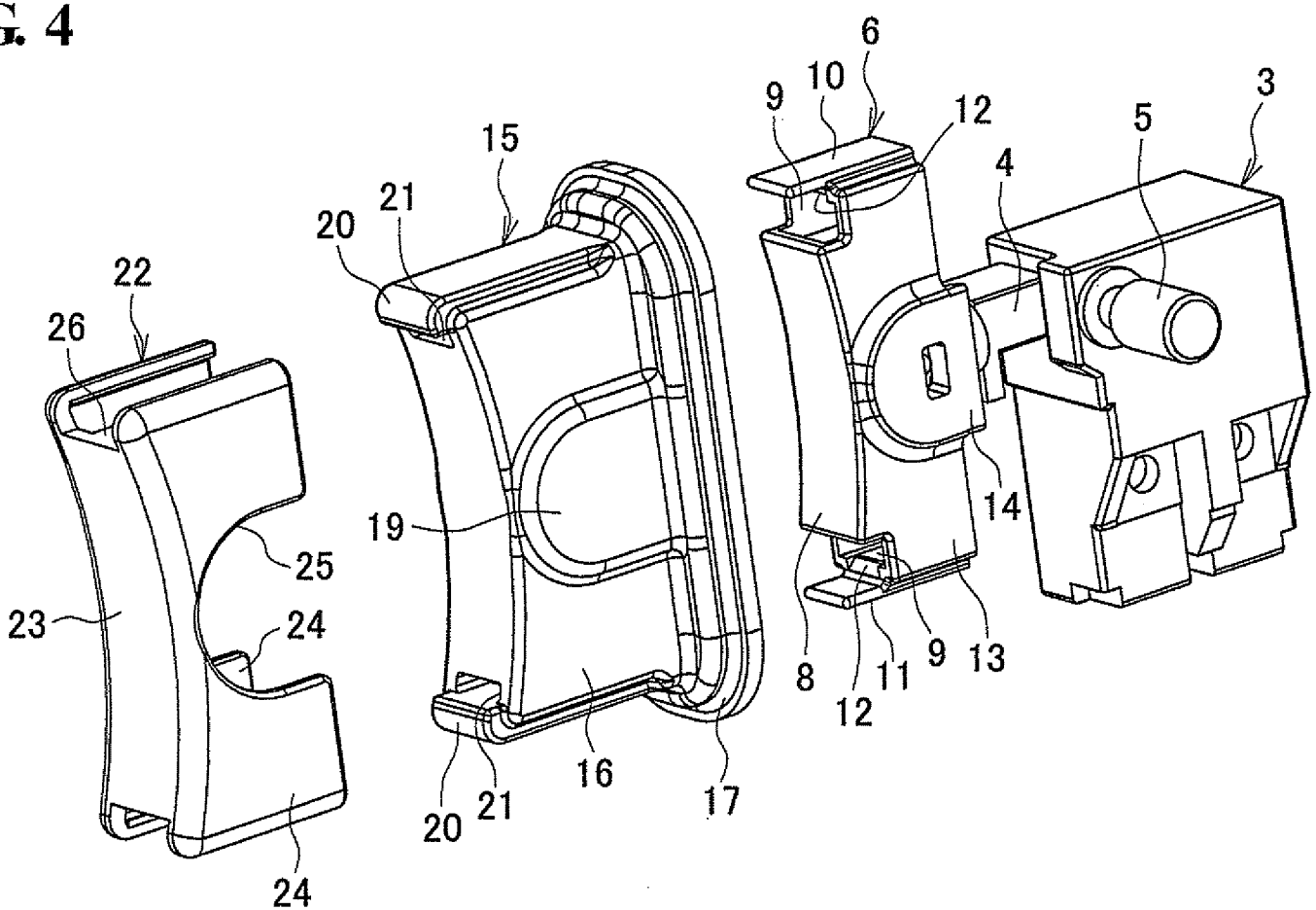
FIG. 4 is an exploded perspective view of a switch mechanism.

A trigger 6 as an example of an operating member is provided on the plunger 4. The trigger 6 protrudes forward through an opening 2 that is shaped like a longitudinal rectangular opening and formed in the handle 107. As also seen in FIG. 4, the trigger 6 is a synthetic resin molding product and shaped to have a longitudinal rectangular cross-section corresponding to the opening 2. The trigger 6 is fixed to the plunger 4 by inserting and fitting the distal end of the plunger 4 into an attachment hole 7 formed in a rear center surface of the trigger 6.

A front plate portion 8 of the trigger 6 has an arcuate surface with its center dent, and guide openings 9 through which engagement nails 26 (to be described later) of the fixing cover 22 are inserted into the trigger 6 are formed adjacent to upper and lower ends of front plate portion 8. An upper plate 10 and a lower plate 11 are provided adjacent to each of the guide openings 9, and each of the lower surface of the upper plate 10 and the upper surface of the lower plate 11 forms an engagement protrusion 12 in the shape of a triangular cross-section which slants downward or upward toward the rear end and the rear surface thereof being flat in the vertical direction. Each engagement protrusion 12 extends laterally along the width of the upper plate 10 or the lower plate 11. Further, an inverted U-shaped protrusion 14 is formed on each right and left side plate 13 of the trigger 6 at an outer surface of and at a vertical center area of the side plate 13.

A rubber cover 15 is attached to the trigger 6 from the front-side of the trigger 6. The rubber cover 15 is made of rubber and includes a closure portion 16 shaped to have a longitudinal rectangular cross-section and contoured to have a profile corresponding to the trigger 6, and a bellows-like flange portion 17 integrally formed around the rear end fringe of the closure portion 16 and expanding as it goes in the rear direction. An engagement groove 18 is formed on an inner perimeter surface of the opening 2 of the handle 107 in such a manner as to extend along the rear end of the inner perimeter surface. The rubber cover 15 is fitted onto the handle 107 with the fringe of the flange portion 17 engaged with the engagement groove 18 to prevent the rubber cover 15 from being pulled out from the handle 107.

The front surface of the closure portion 16 of the rubber cover 15 is formed as an arcuate surface corresponding to the arcuate surface of the front plate portion 8 of the trigger 6 and by which the arcuate surface of the trigger 6 in the protruding position makes contact with the rubber cover 15. Meanwhile, an inverted U-shaped fitting protrusion 19 into which the corresponding protrusion 14 of the trigger 6 is fitted is formed on each right and left side surface of the closure portion 16.

Further, protrusions 20 are provided at upper and lower ends of the front surface of the closure portion 16 of the rubber cover 15. The protrusions 20 protrude forward from the front surface of the closure portion 16. Laterally extending through-openings 21 corresponding to the protrusions 20 are formed in the front surface of the closure portion 16 between the protrusions 20.

The reference numeral 22 indicates a fixing cover. The fixing cover 22 is fixed to the trigger 6 from the front side of the rubber cover 15. The fixing cover 22 is a synthetic resin molding product and shaped to have a U-shaped lateral cross-section. The fixing cover 22 includes an arcuate front plate portion 23 which covers the front surface of the rubber cover 15 between the protrusions 20, and a pair of side plate portions 24 which cover the right and left side surfaces of the rubber cover 15. An inverted U-shaped cut-out 25 into which the corresponding fitting protrusion 19 of the rubber cover 15 is fitted is formed in each of the right and left side plate portions 24.

A pair of upper and lower engagement nails 26 are provided such that they protrude rearward at upper and lower ends of the front plate portion 23. These engagement nails 26 penetrate through the through-openings 21 of the rubber cover 15 and the guide openings 9 of the trigger 6. A barb 27 is formed on the rear end portion of each engagement nail 26. The barb 27 has a triangular cross-section which slants upward or downward from the rear end toward the front end and the front surface thereof being flat in the vertical direction. The barb 27 is provided on the upper surface of the upper engagement nail 26, whereas the barb 27 is provided on the lower surface of the lower engagement nail 26. These barbs 27 are engageable with the corresponding engagement protrusions 12 of the trigger 6 which are an example of engagement portions.

Figure 5:
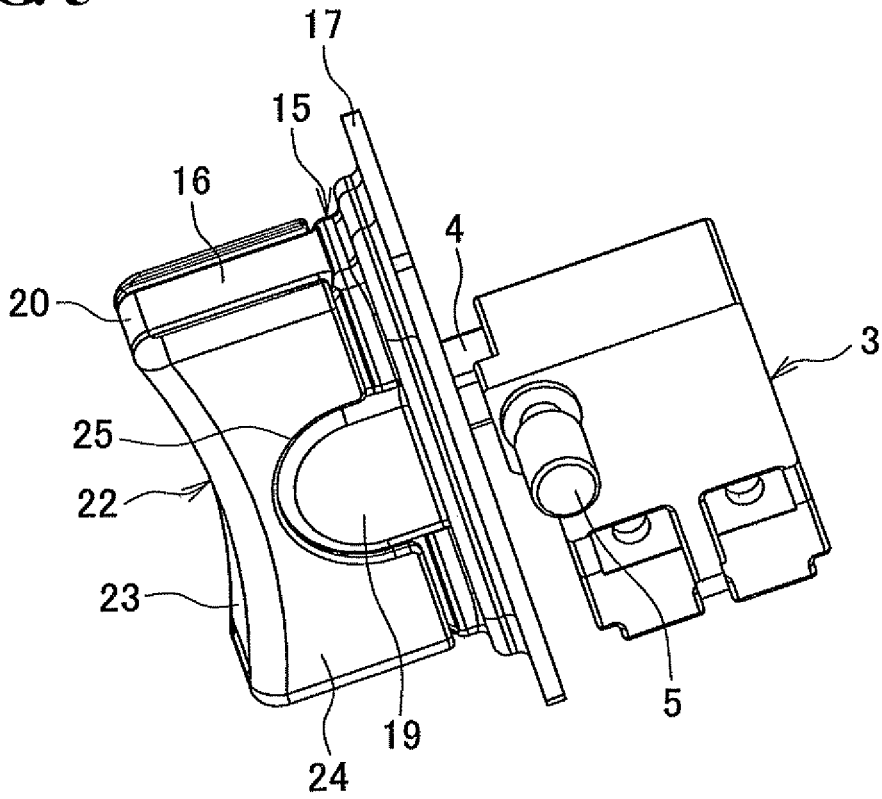
FIG. 5 is a perspective view of the switch mechanism.

According to the seal structure for the switch mechanism as configured above, when the switch 3 is assembled with the handle 107, the rubber cover 15 is first attached to the trigger 6 that is fixed to the plunger 4 from the front-side of the trigger 6 and the trigger 6 is pushed deeply into the closure portion 16 (toward the front end of the closure portion 16). This can cause the protrusions 14 of the trigger 6 to be fitted into and positioned within the corresponding fitting protrusions 19. In this position, the guide openings 9 of the trigger 6 and the through-openings 21 of the rubber cover 15 are aligned and in communication with each other in the front-and-rear direction While retaining this position, the fixing cover 22 is attached to the rubber cover 15 from the front-side of the rubber cover 15 by inserting the engagement nails 26 into the through-openings 21 with the cut-outs 25 being aligned with the fitting protrusions 19. Accordingly, as best seen in FIG. 3, the engagement nails 26 are inserted into the guide openings 9 of the trigger 6, and the barbs 27 are brought into engagement with the engagement protrusions 12, so that the fixing cover 22 is fixed to the trigger 6 over the rubber cover 15. Therefore, as also seen in FIG. 5, the rubber cover 15 is held between the fixing cover 22 and the trigger 6 with its front surface and side surfaces supported from outside by the fixing cover 22. In this position, the protrusions 20 at the upper and lower ends of the rubber cover 15 are positioned above and below the front plate portion 23 of the fixing cover 22. Since the amount of protrusion of the protrusions 20 is substantially the same as the thickness of the front plate portion 23, the protrusions 20 form a continuous surface with the front surface of the front plate portion 23 of the fixing cover 22.

Figure 6:
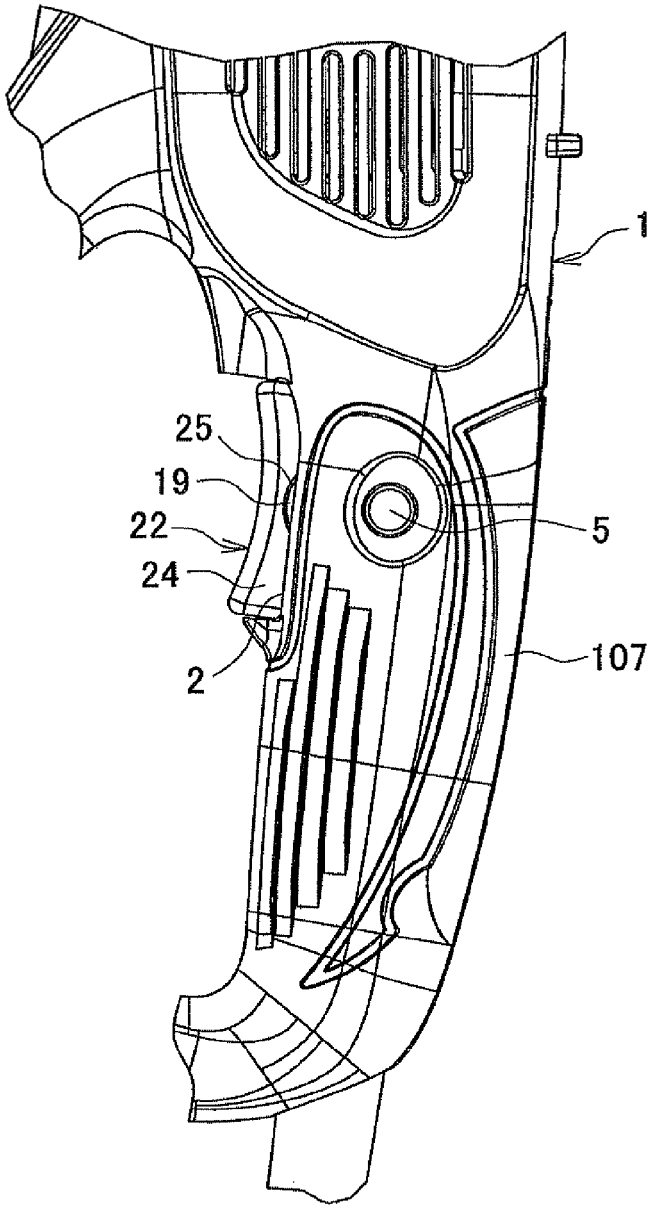
FIG. 6 is a side view of the handle showing a state in which the trigger has been depressed.

When depressing the trigger 6 to which the rubber cover 15 has been fixed through the fixing cover 22 as described above, the switch 3 is turned on and the motor is actuated. The side surfaces of the rubber cover 15 are supported from outside by the side plate portions 24 of the fixing cover 22, and when the trigger is depressed, the side plate portions 24 of the fixing cover 22 are almost entirely positioned at the edge of the opening 2 as shown in FIG. 6. Therefore, the side surfaces of the rubber cover 15 are less likely to sag and contact the edge of the opening 2. According to this embodiment, the fitting protrusions 19 of the rubber cover 15 are exposed to view through the cut-outs 25 formed in the side plate portions 24. However, since the front side and the upper and lower sides of the rubber cover 15 are supported by the front plate portion 23 and the side plate portions 24, the fitting protrusions 19 are in close contact with the trigger 6 and less likely to sag, so that the fitting protrusions 19 hardly contact the edge of the opening 2.

Meanwhile, when the lock-on button 5 is depressed while the trigger 6 is kept in the depressed position, the trigger 6 together with the plunger 4 is locked in the depressed position. Even in this instance, as best seen in FIG. 6, the rubber cover 15 is retreated together with the trigger 6 by means of the fixing cover 22. Therefore, the user can easily recognize that the trigger 6 is in the depressed position.

In the case where water is supplied during the grinding operation using the tool bit 104, the user moves the lever 111 in a lateral direction using a finger of his hand holding the handle 107. This makes the valve 110 to be opened so that water from the supply source flows through the hose 112 and the nozzle portion 113 into the water filling portion 114 and then flows through the conduit 115 of the rotary shaft 103 and is ejected from the ejection port 116. Therefore, dust which occurs during the grinding operation can be discarded with water without scattering of the dust. Even in the case of the disc sander 1 equipped with the water filling mechanism 109, the rubber cover 15 can prevent water from entering the gap between the opening 2 of the handle 107 and the trigger 6 to thereby maintain sealing performance.

As described previously, according to the seal structure for the switch mechanism of the disc sander 1 in this embodiment, the rubber cover 15 is attached to the trigger 6 from the front-side of the trigger 6 and the rear end of the rubber cover 15 is engaged with the opening 2, and the fixing cover 22 is fixed to the trigger 6 from outside the rubber cover 15 so as to integrate the rubber cover 15 with the trigger 6. Therefore, the gap between the opening 2 of the handle 107 and the trigger 6 can be suitably sealed by the rubber cover 15. Further, a damage of the rubber cover 15 can be suppressed and an excellent durability of the seal can be obtained.

In particular, since the fixing cover 22 has a U-shaped transverse section for covering the front surface and the right and left side surfaces of the rubber cover 15, it is possible to more effectively prevent the side surfaces of the rubber cover 15 from contacting the edge of the opening 2.

Further, since the fixing cover 22 has the engagement nails 26 which penetrate through the rubber cover 15 and engageable with the engagement protrusions 12 provided on the trigger 6, the fixing cover 22 can be easily fixed to the trigger 6.

Further, since the switch 3 has the lock-on mechanism configured to maintain the trigger 6 in the ON-state, in which the trigger 6 has been depressed and moved in the backward position, the use state of the lock-on mechanism is reliably recognized and better usability can be achieved.

According to the above embodiment, the protrusion formed on the center area of each side surface of the trigger is fitted into the corresponding fitting protrusion formed on each side surface of the rubber cover, and further the fitting protrusion is fitted into the corresponding cut-out formed in each side plate portion of the fixing cover. However, the fitting position thereof is not limited to the vertical center area. The fitting position may vary where appropriate, and a plurality of fitting positions may be provided. Further, the shape of these protrusions is not limited to a specific shape such this U-shape, and various selections may be made. For example, a ridge extending in the front-and-rear direction may be employed. Further, the relationship between the protrusion and the cut-out may be inverted. Especially, if a recess portion is formed in the inner surface of each side plate portion of the fixing cover in place of the cut-out so that the fitting protrusion of the rubber cover is fitted into the recess portion, the entire side surface of the rubber cover can be covered with the fixing cover. However, such a fitting-engagement structure may be omitted.

Furthermore, in the embodiment including the engagement nails and the engagement portions, design variations may be made, for example, by changing the installation positions, the shapes, and the number of the engagement nails and the engagement portions. The engagement nails and the engagement portions may be to provided in an inverted position. Of course, an embodiment other than that including the engagement nails and the engagement portions may be made and another coupling means such as for fitting the fixing cover that is integrated with the rubber cover onto the trigger may be employed.

Further, the specific shapes of the trigger, the rubber cover and the fixing cover may be modified where appropriate. In particular, the shapes of the rubber cover and the fixing cover can be modified in conformity with the shape of the trigger. As long as the fixing cover is fixed to the trigger, the fixing cover may be configured to have a shape for covering the entire outer surfaces of the rubber cover except the rear surface thereof.

In the above embodiment, the trigger which is depressed in the linear direction is employed as an example of the operating member. However, the present invention is not limited to this specific configuration, and the seal structure according to the present invention is applicable, for example, to a switch lever having one end axially-supported on a housing so that the switch lever is moved along a circular-arc locus.

Further, the seal structure according to the present invention is applicable to a switch mechanism without a lock-on mechanism, or a switch mechanism with a so-called lock-off mechanism in which the depression of a normally-locked operating member is allowed only when the user carries out an unlocking operation. The durability of the rubber cover for these switch mechanism can be improved by employing the seal structure according to the present invention.

Of course, the present invention is applicable to other electric power tools such as a grinder and a drill (not limited to motor-driven type equipment). Further, the present invention is applicable to equipment other than electric power tools, as long as the equipment includes a switch operated by depression of the operating member.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A seal structure for a switch mechanism comprising:

a switch disposed in a housing;

an operating member protruding forward from the housing through an opening formed in the housing and configured to turn on or off the switch;

a rubber cover attached to the operating member from a front-side of the operating member and having a rear end engageable with the opening; and a fixing cover fixed to the operating member from outside the rubber cover so as to integrate the rubber cover with the operating member, wherein the rubber cover seals a gap between the opening and the operating member, and an inverted U-shaped protrusion is formed on each right and left side surface of the operating member, and a fitting protrusion corresponding to the protrusion of the operating member is formed on each right and left side surface of the rubber cover so that when the rubber cover is attached to the operating member, the protrusions are fitted into the fitting protrusions.

2. The seal structure according to claim 1, wherein the fixing cover has a U-shaped transverse section for covering a front surface and right and left side surfaces of the rubber cover.

3. The seal structure according to claim 1, wherein the switch has a lock-on mechanism configured to maintain the operating member in an ON-state, in which the operating member has been depressed and moved in a backward position.

4. The seal structure according to claim 3, wherein the lock-on mechanism has a lock-on button provided on a side surface of the switch and protrudes sideward through a through-opening of the housing, and the operating member is maintained in the backward position by depressing the lock-on button toward the switch.

5. The seal structure according to claim 1, wherein a bellows-like flange portion is formed at a rear end of the rubber cover, and the flange portion is engaged with an engagement groove formed on an inner perimeter surface of the opening.

6. The seal structure according to claim 1, wherein a cut-out corresponding to the fitting protrusion of the rubber cover is formed in each right and left side plate portion of the fixing cover so that the fitting protrusions can be fitted into the cut-outs.

7. The seal structure according to claim 1, further comprising an engagement nail, wherein a barb is formed on an end portion of each engagement nail.

8. The seal structure according to claim 1, wherein a front surface of the operating member has an arcuate surface with its center part retracted deepest, and wherein a front surface of the rubber cover and a front surface of the fixing cover have arcuate surfaces in conformity with the front surface of the operating member.

9. An electric power tool comprising:

a switch mechanism including the switch provided in the housing, and the operating member protruding forward from the housing through the opening formed in the housing and configured to turn on or off the switch, wherein the seal structure of claim 1 is adopted for the switch mechanism.

10. The electric power tool according to claim 9, wherein a fluid supply mechanism is provided so as to supply fluid to a tool bit attached to the housing.

11. A seal structure for a switch mechanism comprising:

a switch disposed in a housing;

an operating member protruding forward from the housing through an opening formed in the housing and configured to turn on or off the switch;

a rubber cover attached to the operating member from a front-side of the operating member and having a rear end engageable with the opening; and a fixing cover fixed to the operating member from outside the rubber cover so as to integrate the rubber cover with the operating member, wherein the fixing cover has at least two engagement nails which penetrate through the rubber cover and are engageable with an engagement portion provided on the operating member, the rubber cover seals a gap between the opening and the operating member, protrusions which protrude forward are provided at upper and lower ends of the front surface of the rubber cover, through-openings corresponding to the protrusions are formed in the front surface of the rubber cover between the protrusions, the fixing cover has a front plate portion which covers the front surface of the rubber cover between the protrusions, at least one of the engagement nails penetrating through the through-openings is provided at an upper end of the front plate portion, and at least one of the engagement nails penetrating through the through-openings is provided at a lower end of the front plate portion.

* * * * *